US011137220B2

(12) United States Patent
Allred et al.

(10) Patent No.: US 11,137,220 B2
(45) Date of Patent: Oct. 5, 2021

(54) BOILING PROCESSES AND SYSTEMS THEREFOR HAVING HYDROPHOBIC BOILING SURFACES

(71) Applicant: Purdue Research Foundation, West Lafayette, IN (US)

(72) Inventors: Taylor Phillip Allred, West Lafayette, IN (US); Justin A. Weibel, West Lafayette, IN (US); Suresh V. Garimella, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 134 days.

(21) Appl. No.: 16/444,155

(22) Filed: Jun. 18, 2019

(65) Prior Publication Data

US 2020/0292251 A1 Sep. 17, 2020

Related U.S. Application Data

(60) Provisional application No. 62/686,317, filed on Jun. 18, 2018.

(51) Int. Cl.
*F28F 13/18* (2006.01)

(52) U.S. Cl.
CPC ..... *F28F 13/187* (2013.01); *F28F 2245/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,291,758 | A | 9/1981 | Fujii et al. | |
| 4,730,665 | A | 3/1988 | Cutchaw | |
| 4,884,169 | A | 11/1989 | Cutchaw | |
| 5,814,392 | A | 9/1998 | You et al. | |
| 6,119,770 | A | 9/2000 | Jaber | |
| 7,353,860 | B2 | 4/2008 | Erturk et al. | |
| 7,749,962 | B2 | 7/2010 | Wieder | |
| 2007/0102070 | A1 | 5/2007 | Tuma et al. | |
| 2007/0202321 | A1 | 8/2007 | You | |
| 2009/0226701 | A1 | 9/2009 | Carbone | |
| 2011/0023726 | A1 | 2/2011 | Nesbitt | |
| 2012/0279068 | A1 | 11/2012 | Mahefkey et al. | |
| 2014/0116052 | A1* | 5/2014 | Noguchi | F22B 35/10 60/679 |

OTHER PUBLICATIONS

Enhanced nucleate boiling on horizontal hydrophobic-hydrophilic carbon nanotube coatings; Dai et al.; Applied Physics Letters (Year: 2013).*

Super-Hydrophobic PDMS Surface with Ultra-Low Adhesive Force; Jin et al.; Macromolecular Rapid Communications; (Year: 2005).*

(Continued)

*Primary Examiner* — Devon Russell

(74) *Attorney, Agent, or Firm* — Hartman Global IP Law; Gary M. Hartman; Domenica N. S. Hartman

(57) ABSTRACT

Systems and methods that utilize enhanced boiling surfaces to promote the efficiency of boiling. Such a system has a surface that is hydrophobic and exhibits a sufficiently low receding contact angle to a liquid such that vapor spreading during bubble growth and premature transition to film boiling is mitigated.

20 Claims, 7 Drawing Sheets

(56) References Cited

OTHER PUBLICATIONS

Sticky superhydrophobic surface; Guo et al.; Applied Physics Letters; (Year: 2007).*
Hydrophobic Polydimethylsiloxane (PDMS) Coating of Mesoporous Silica and Its Use as a Preconcentrating Agent of Gas Analytes; Park et al.; Langmuir; American Chemical Society; (Year: 2014).*
International Search Report and Written Opinion for PCT/US2013/042713, dated Sep. 5, 2013, (10 pages).

* cited by examiner smooth copper sparse nucleation smooth PDMS dense nucleate boiling across surface smooth Teflon full vapor coverage

BOILING PROCESSES AND SYSTEMS THEREFOR HAVING HYDROPHOBIC BOILING SURFACES

CROSS-REFERENCE TO RELATED APPLICATIONS

This application claims the benefit of U.S. Provisional Application No. 62/686,317, filed Jun. 18, 2018, the contents of which are incorporated herein by reference.

STATEMENT REGARDING FEDERALLY SPONSORED RESEARCH

This invention was made with government support under Contract No. N000141613109 awarded by the Office of Naval Research. The government has certain rights in the invention.

BACKGROUND OF THE INVENTION

The present invention generally relates to boiling processes and systems therefor. The invention particularly relates to boiling processes and systems that utilize enhanced boiling surfaces.

Boiling is prevalent in staple industrial processes such as distillation, power generation, and cooling, including refrigeration. In boiling, the heat removal capacity for a cooling medium is limited by the upper limit of cooling, i.e., the critical heat flux (CHF), where the heat transfer coefficient decreases dramatically because the boiling regime at surfaces contacted by the medium ("boiling surfaces") is changed from nucleate boiling to film boiling, with the result that vapor spreads over the boiling surfaces. Because such conditions can be a catastrophic failure mechanism, CHF enhancement is of great interest, particularly in view of current trends in high-performance computing, electric vehicles, renewable energy conversion, telecommunications, and laser diode applications that demand high heat fluxes to be efficiently removed from surfaces maintained at a relatively low temperature. CHF enhancement in saturated boiling is generally influenced by the effects of the extended surface area, nucleation site density, wettability of the boiling surface, capillary wicking, and wavelength decrease based on the modified Zuber hydrodynamic stability model. However, the contribution of each of these effects are not fully understood and therefore are topics of ongoing study.

The wettability of boiling surfaces has emerged as a key factor in their heat transfer efficacy. As is well known, wettability refers to the degree of contact between a liquid and a solid surface. A liquid contacting a highly wettable (hydrophilic) surface will tend to spread out over the surface, whereas the same liquid will tend to form a spherical droplet on a hydrophobic surface, i.e., one that exhibits low wettability. Wettability can be quantified by measuring the equilibrium (static) contact angle, defined as the angle between the surface of a liquid droplet and the surface contacted by the droplet. Assuming the same liquid and same conditions, a droplet will form a higher contact angle on a relatively hydrophobic surface than a hydrophilic surface. As used herein, hydrophilic surfaces will be referred to as those exhibiting a contact angle of less than 90°, hydrophobic surfaces will be referred to as those exhibiting a contact angle of greater than 90°, superhydrophilic surfaces will be referred to as those exhibiting a contact angle approaching zero and characterized by capillary wicking, and superhydrophobic surfaces will be referred to as those exhibiting a contact angle of greater than 150°. Due to the observation of contact angle hysteresis, wettability is also described in reference to an advancing (maximal) contact angle and a receding (minimal) contact angle, between which the static contact angle resides.

Research into the wettability of smooth boiling surfaces have reported that hydrophilic surfaces and textured superhydrophilic surfaces tend to delay critical heat flux through improved rewetting. However, at lower heat fluxes in the nucleate boiling regime, hydrophilic surfaces have less efficient heat transfer compared to hydrophobic surfaces. Hydrophobic surfaces exhibit boiling incipience at lower surface temperatures and yield higher nucleation site densities in the nucleate boiling regime, which leads to efficient heat transfer at low heat fluxes. However, hydrophobic surfaces are commonly reported as promoting premature film boiling, leading to prohibitive surface temperatures at moderate to high heat fluxes. Surfaces endowed with a combination of hydrophobicity and hydrophilicity ("biphilic" surfaces) have been developed in an effort to capitalize on the benefits of hydrophobicity while mitigating its disadvantages.

Texturing hydrophobic surfaces can lead to a variety of unique boiling behaviors based on the wetting state of water on surface structures. While various wetting states have been proposed, the Cassie-Baxter and the Wenzel states are well-known states that exhibit distinctly different dynamic wetting behavior. Surfaces that can sustain a Cassie-Baxter state, in which droplets rest on top of surface structures, are considered superhydrophobic and have extreme water-repellent behavior (contact angles greater than 150° and roll-off angles less than 10°). However, the Cassie-Baxter state is often metastable. If an energy barrier is overcome, the droplet sinks into the surface structures in a transition to the Wenzel state, in which droplets also have high static contact angles but are strongly pinned in place due to high contact angle hysteresis. In boiling, superhydrophobic surfaces have commonly been shown to transition to film boiling upon incipience, rendering them less useful if not useless in applications despite having favorable incipience superheats. The authors of Allred et al., "Enabling highly effective boiling from superhydrophobic surfaces," Phys. Rev. Lett. 120 (2018) 174501, incorporated herein by reference, demonstrated the ability to limit vapor spreading during boiling on superhydrophobic surfaces by bringing these surfaces into the Wenzel state prior to boiling. In this state, the three-phase contact line is strongly pinned and bubbles grow with a fixed contact diameter, leading to minimal vapor coverage of the surface and enabling highly effective boiling up to high heat fluxes approaching Zuber's theoretical limit. This result indicated that, if favorable dynamic wetting behavior can be achieved, the advantageous incipience and nucleation behavior characteristic of hydrophobic surfaces can be leveraged to improve boiling, without a detriment to critical heat flux.

The findings of Allred et al. provide a basis for exploring parahydrophobic surfaces for boiling applications. Though a consensus is lacking as to the specific wetting characteristics that define parahydrophobicity, a surface is typically regarded as being parahydrophobic if it has a high static contact angle (approaching or exceeding 150° and a droplet can remain adhered to a surface when tilted at 90° or inverted. In any event, a surface satisfying the notional criteria for 'parahydrophobicity' does not automatically ensure that it will yield advantageous boiling characteristics.

The wetting behavior, commonly known as the "petal effect," of parahydrophobic surfaces has recently come to the attention of the scientific community due to it being observed on natural surfaces such as the rose petal and the peanut leaf, among others. Water droplets placed on a parahydrophobic surface can remain adhered even when the surface is inverted, despite having contact angles approaching or exceeding 150°. Parahydrophobic surfaces have never been investigated for boiling applications, but have demonstrated the unique ability to pin droplets and air bubbles in place due to the high contact angle hysteresis on the surface, suggesting they may mitigate vapor spreading during bubble growth. Parahydrophobicity would seem to represent ideal characteristics desired for boiling: its hydrophobity offers favorable incipience characteristics for efficient nucleate boiling, while its contact line pinning limits vapor spreading over the surface, thus delaying critical heat flux. Unlike superhydrophobic surfaces, parahydrophobic surfaces cannot support a low-hysteresis Cassie-Baxter state, so that there is no risk of premature film boiling.

BRIEF DESCRIPTION OF THE INVENTION

The present invention provides systems and methods that utilize enhanced boiling surfaces to promote the efficiency of boiling.

According to one aspect of the invention, a system is provided that includes a surface configured for boiling a liquid. The surface is hydrophobic and exhibits a sufficiently low receding contact angle to the liquid such that vapor spreading during bubble growth and premature transition to film boiling is mitigated. A droplet of the liquid placed on the surface remains adhered thereto when the surface is tilted at 90° or inverted.

Another aspect of the invention is a method of boiling a liquid that entails preparing a surface to be hydrophobic and have a receding contact angle, wherein a droplet of the liquid placed on the surface remains adhered thereto when the surface is tilted at 90° or inverted, and then bringing the liquid into contact with the surface and boiling the liquid. The receding contact angle is sufficiently low such that vapor spreading during bubble growth and premature transition to film boiling is mitigated.

Technical effects of the system and method described above preferably include the capability of providing boiling surfaces that exhibit an advantageous low-superheat boiling incipience and high active nucleation site densities commonly observed on hydrophobic surfaces, while exhibiting high contact angles and low receding contact angles to reduce the likelihood of vapor spreading over the surface during bubble growth. Such boiling performance enhancements can be advantageously utilized in a variety of applications, including but not limited to distillation, power generation, and cooling systems such as refrigeration systems.

Other aspects and advantages of this invention will be appreciated from the following detailed description.

BRIEF DESCRIPTION OF THE DRAWINGS

FIG. 1 contains images (a)-(f) that show static 5 μL droplets on (a) a smooth copper surface, (b) a smooth PDMS-coated surface, and (c) a smooth TEFLON®-coated surface, and receding droplets on (d) a smooth copper surface, (e) a smooth PDMS-coated surface, and (f) a smooth TEFLON®-coated surface. FIG. 1 further contains a graph that represents boiling curves (heat flux versus surface superheat) for each of the surfaces shown in images (a)-(f). Calculated uncertainties in heat flux and surface superheat were less than 3 W/cm$^2$ and 0.7 K, respectively. X's and arrows indicate transient critical heat flux points and subsequent temperature excursions. The horizontal dashed line indicates the critical heat flux predicted by Zuber's proposed hydrodynamic limit.

FIG. 2A shows sparse nucleate boiling from a smooth copper surface (heat flux: 8.3 W/cm$^2$; superheat: 9.9 K). FIG. 2B shows dense nucleate boiling from a smooth PDMS-coated surface (7.5 W/cm$^2$; 7.9 K). FIG. 2C shows film boiling from a smooth TEFLON®-coated surface (6.7 W/cm$^2$; 36.7 K).

FIG. 5 further contains a graph representing boiling curves (heat flux versus surface superheat) for the textured PDMS-coated surfaces compared with the smooth copper and PDMS-coated surfaces. Calculated uncertainties in heat flux and superheat are less than 3 W/cm$^2$ and 0.7 K, respectively. Crosses with a rightward arrow indicate critical heat flux and subsequent temperature excursions. The horizontal dashed line indicates the critical heat flux predicted by Zuber's proposed hydrodynamic limit.

FIG. 7 further contains a graph represents boiling curves (heat flux versus surface superheat) for the two parahydrophobic surfaces with insets showing the receding contact angle measurements for each surface. Calculated uncertainty for the heat flux and superheat are less than 3 $W/cm^2$ and 0.7 K, respectively. Cross with a rightward arrow indicates critical heat flux and the subsequent temperature excursion. The horizontal dashed line indicates the critical heat flux predicted by Zuber's proposed hydrodynamic limit.

DETAILED DESCRIPTION OF THE INVENTION

Figure 1:
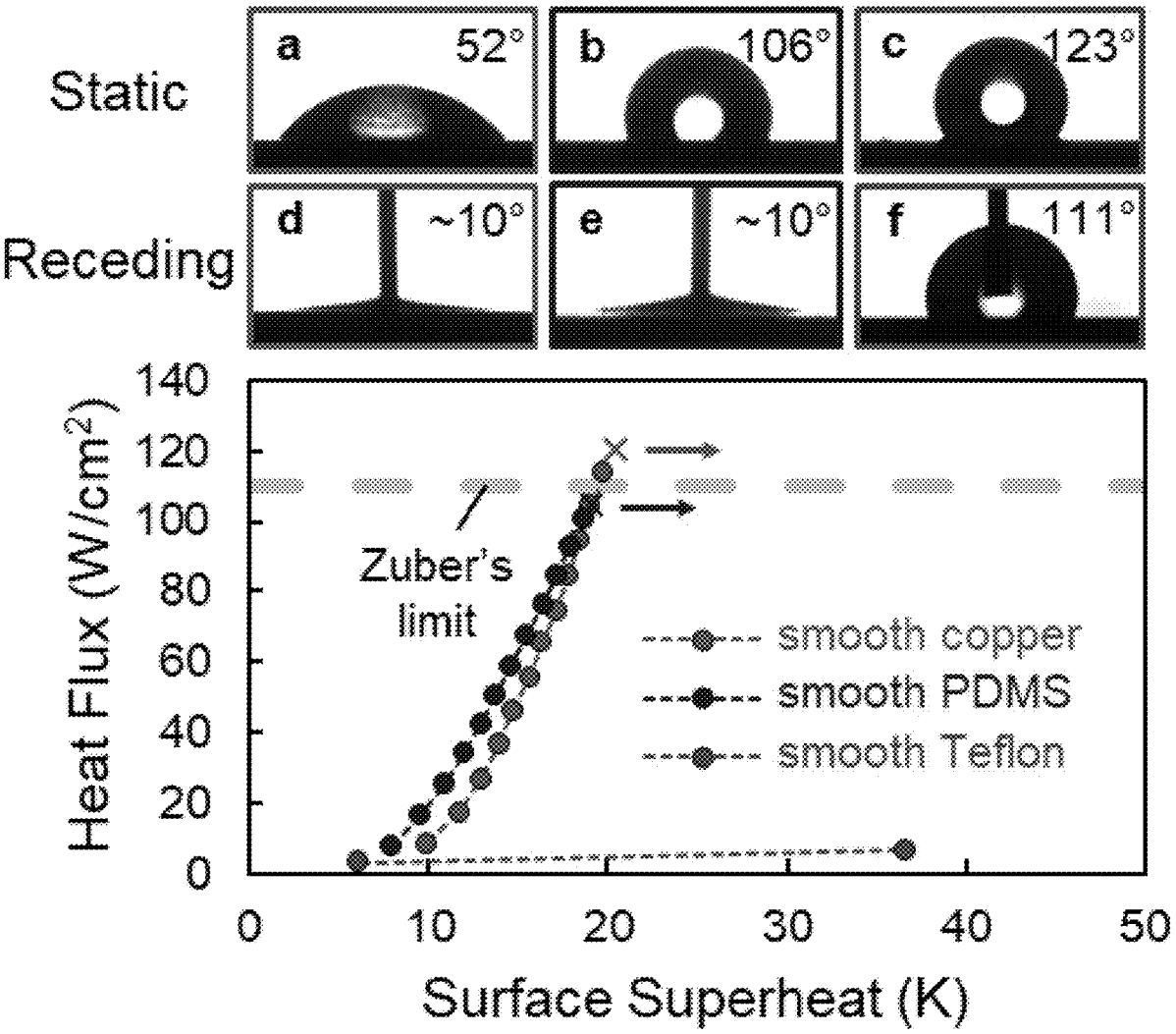
FIG. 1 represents wettability characterization and boiling results for smooth hydrophilic and hydrophobic surfaces.

Disclosed herein are systems and methods that utilize enhanced boiling surfaces with a particular focus on the wettability of enhanced boiling surfaces. Investigations leading to the present invention identified certain hydrophobic surfaces as desirable for the enhancement of boiling surfaces, especially hydrophobic and parahydrophobic surfaces with low receding contact angles. As previously noted, there is currently no consensus in the art on the specific wetting characteristics that define parahydrophobicity, but a surface is typically regarded as being parahydrophobic if it has a high static contact angle (approaching or exceeding 150°) and high contact angle hysteresis, that is, water droplets placed on a parahydrophobic surface can remain adhered even when the surface is tilted at 90° or inverted, despite having contact angles approaching or exceeding 150°.

As also previously noted, a surface satisfying the notional criteria for 'parahydrophobicity' does not necessarily ensure that it will yield the advantageous boiling characteristics demonstrated by in experimental investigations discussed below that led to the present invention. Because adhesion of a droplet to a surface when tilted is governed by the contact angle hysteresis, all notionally parahydrophobic surfaces do not necessarily possess the low receding contact angle required for maintaining nucleate boiling. Therefore, only a certain subset of parahydrophobic surfaces having suitably low receding contact angles exhibit the advantages disclosed herein. In particular, these surfaces have receding contact angles that are sufficiently low to mitigate vapor spreading and prolong critical heat flux.

This subset of parahydrophobic surfaces provides characteristics desirable for boiling. For example, these surfaces offer favorable incipience characteristics for efficient nucleate boiling and contact line pinning (e.g., ability to pin droplets and air bubbles in place), resulting from the low receding contact angle, which limit vapor spreading over the surface to delay CHF. Unlike superhydrophobic surfaces, parahydrophobic surfaces having low receding contact angles do not support a low-hysteresis Cassie-Baxter state, so film boiling is not an issue.

Nonlimiting embodiments of the invention will now be described in reference to the experimental investigations leading up to the invention. In these investigations, the boiling behavior of hydrophobic surfaces with various dynamic wetting properties were investigated. Both smooth and textured surfaces were coated with polydimethylsiloxane (PDMS), a hydrophobic material with high contact angle hysteresis, and TEFLON®, a hydrophobic material with low contact angle hysteresis. Surfaces exhibiting wetting behavior ranging from lotus-leaf-like superhydrophobic properties to rose-petal-like parahydrophobic properties were evaluated, which allowed identification of critical factors that govern bubble dynamics and the propensity for film boiling on hydrophobic surfaces.

As explained in Allred et al. (supra), surfaces that can sustain a Cassie-Baxter state, in which droplets rest on top of surface structures, are considered superhydrophobic and have extreme water-repellent behavior (contact angles greater than 150° and roll-off angles less than 10°). However, the Cassie-Baxter is often metastable, and if the energy barrier to transition is overcome, the droplet impinges into the surface structures and resides in the Wenzel state. In this state, droplets also have high static contact angle, but are highly pinned in place due to high contact angle hysteresis.

As also previously discussed, in boiling conditions superhydrophobic surfaces have commonly been shown to transition to film boiling upon incipience, rendering them less useful if not useless for applications despite having favorable incipience superheats. The investigations described in Allred et al. demonstrated the ability to limit vapor spreading during boiling on superhydrophobic surfaces, enabling sustained nucleate boiling to heat fluxes approaching Zuber's theoretical limit. This behavior was achieved in Allred et al. by bringing a superhydrophobic surface into the high-contact-angle-hysteresis Wenzel state prior to boiling. In this state, the three-phase contact line was highly pinned and bubbles grew with a fixed contact diameter, leading to minimal vapor coverage of the surface. On the other hand, when boiling occurred from the same surface in the low-contact-angle-hysteresis Cassie-Baxter state, the three-phase contact line was free to move during bubble growth; vapor bubbles spread over the surface and led to the premature onset of film boiling. This result indicated that the advantageous incipience and nucleation behavior characteristic of hydrophobic surfaces can be leveraged to improve boiling, without a detriment to CHF, if a favorable dynamic wetting behavior can be achieved. However, in many applications, it is generally undesirable to utilize a superhydrophobic surface for risk of the Cassie-Baxter state occurring and jeopardizing the system performance.

In the experimental investigations reported below, the boiling behavior of hydrophobic surfaces with various dynamic wetting properties were evaluated, including both smooth and textured surfaces coated with polydimethylsiloxane (PDMS), a hydrophobic material with high contact angle hysteresis, or TEFLON® (polytetrafluoroethylene; PTFE), a hydrophobic material with low contact angle hysteresis. The test surfaces were in the form of aluminum test blocks. Prior to coating or texturing, the surfaces were initially prepared to be "smooth" by wet-sanding to a roughness of 400-600 nm ($R_a$), which meets the general category of a high-grade surface finish of 0.8 μm $R_a$ or less. Textured surfaces were obtained by etching smooth surfaces, as described below. Surfaces exhibiting wetting properties ranging from superhydrophobic to parahydrophobic were evaluated, which allowed for identification of factors that govern bubble dynamics and proclivity for film boiling on hydrophobic surfaces.

Boiling experiments with smooth surfaces were carried out to determine the impact of the wetting behavior of the two different hydrophobic coating materials in comparison with a smooth hydrophilic copper baseline. The boiling curves for each of these surfaces (smooth copper, smooth PDMS-coated, and smooth TEFLON®-coated), along with the static and receding contact angle measurements of the hydrophobic surfaces, are shown in FIG. 1. The hydrophilic copper baseline surface, having a static contact angle of 52° and a receding contact angle of about 10°, behaved as expected, exhibiting nucleate boiling behavior and reaching critical heat flux near Zuber's predicted limit. The PDMS-coated surface had a high static contact angle (106°), but a similarly low receding contact angle (about 10°). This surface sustained nucleate boiling and a cooler surface temperature than the baseline copper surface at all steady state points on the boiling curve and had a similar critical heat flux. The TEFLON®-coated surface had high static and receding contact angles (123° and 111°, respectively). This surface maintained a low surface temperature for the single heat flux in which it remained in the nucleate boiling regime (3.3 W/cm$^2$), but quickly transitioned to film boiling at less than 10 W/cm$^2$, resulting in a very high superheat.

Figure 2A:
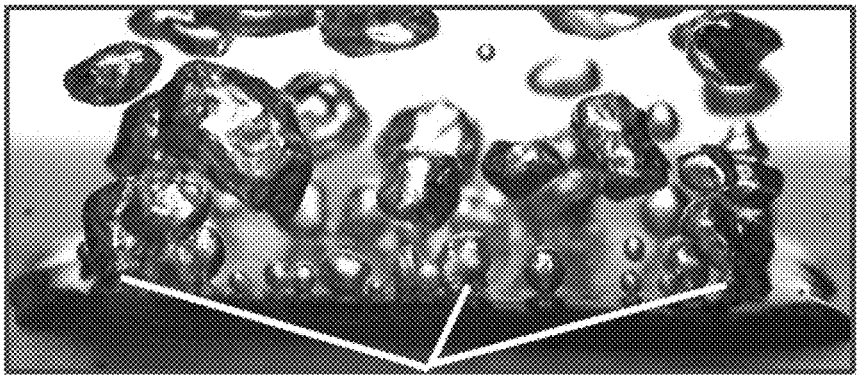
FIGS. 2A, 2B, and 2C contain images comparing the boiling behavior on smooth surfaces.
Figure 2B:
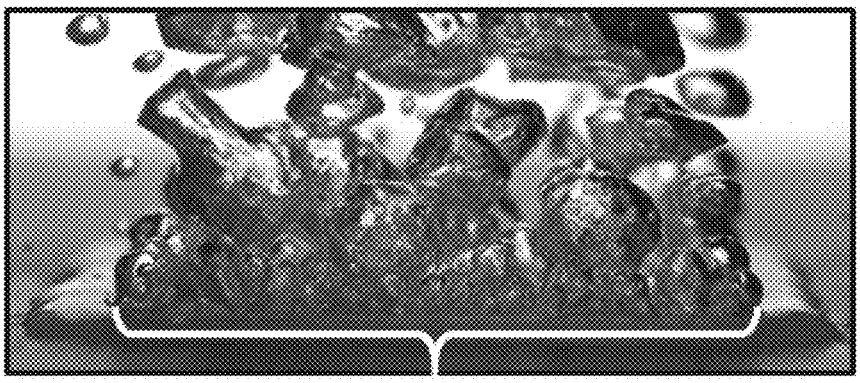
Figure 2C:
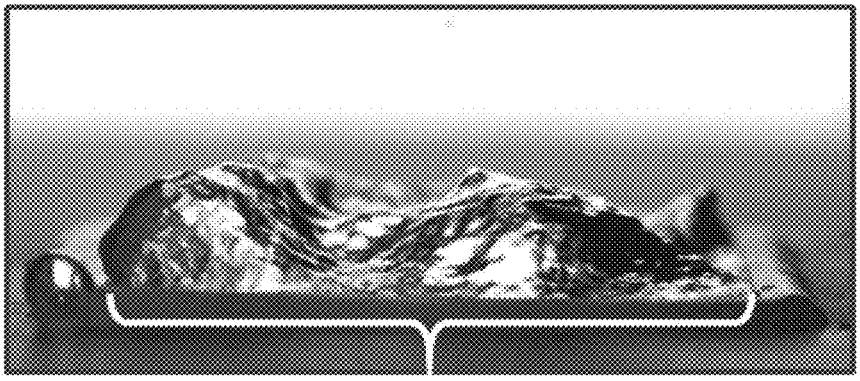

The boiling behavior at a low heat flux below 10 W/cm$^2$ is shown for each of these smooth surfaces in FIGS. 2A, 2B, and 2C. The behavioral differences that resulted in the differing boiling performance of the surfaces are evident. The copper and PDMS-coated surfaces both exhibited nucleate boiling, but more active nucleation sites were observed on the hydrophobic PDMS-coated surface, resulting in a lower surface superheat (7.9 K) on this surface compared to the smooth copper (9.9 K). The TEFLON®-coated surface was blanketed in insulating vapor resulting in high surface superheats. Interestingly, even though the two hydrophobic PDMS-coated and TEFLON®-coated surfaces have similar wettability in terms of the static contact angle, their boiling behavior was drastically different. The bubble dynamics observed on the PDMS-coated surface align more closely with the hydrophilic baseline surface.

Figure 3:
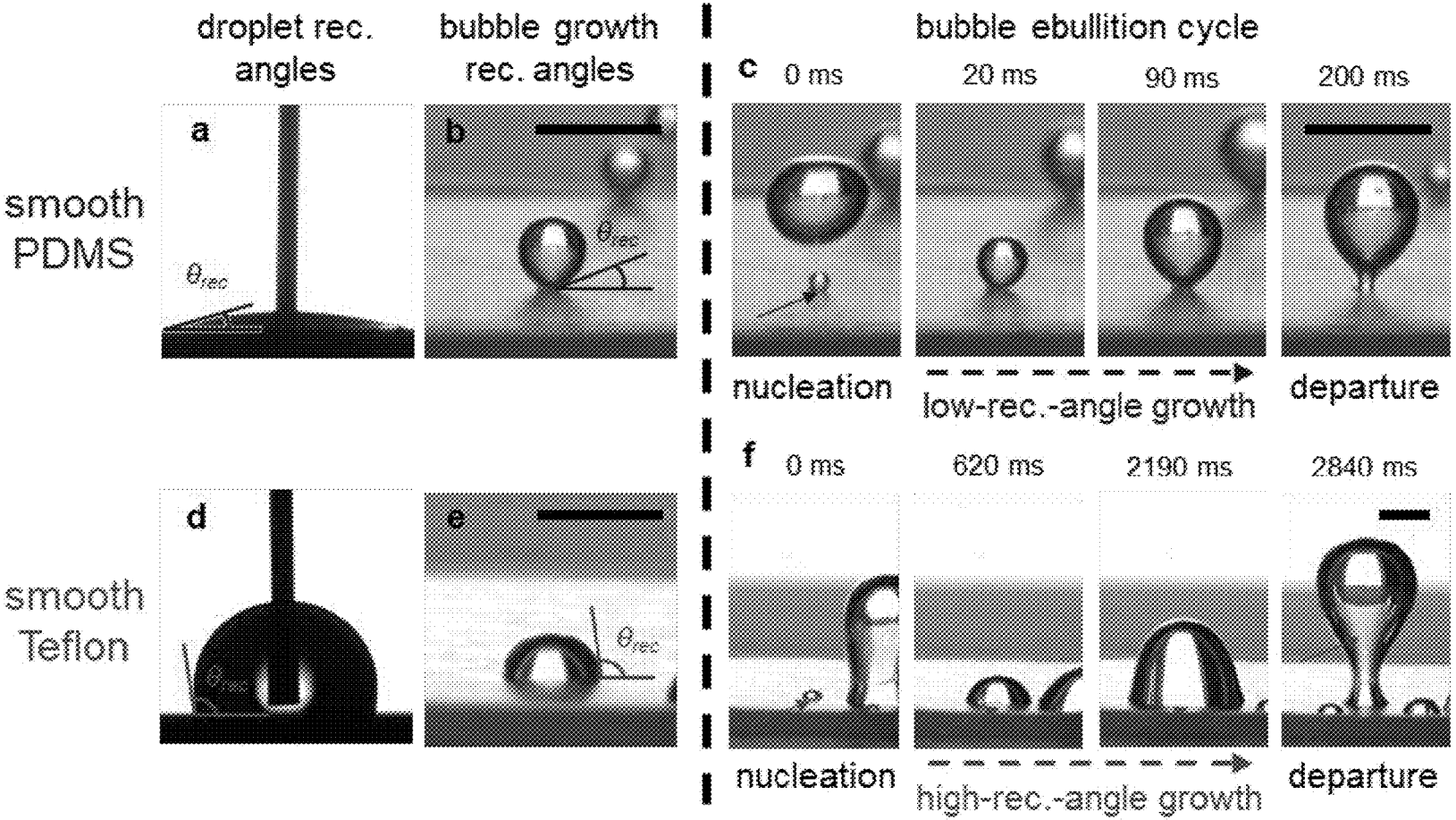
FIG. 3 represents bubble growth dynamics and ebullition cycle. Image (a) shows a receding contact angle measurement of a droplet on a smooth PDMS-coated surface and image (b) shows a similarly small receding contact angle during bubble growth on the same surface. Image (c) shows a bubble ebullition cycle on a PDMS-coated surface exhibiting low-receding-angle growth. Image (d) shows a receding contact angle measurement of a droplet on a TEFLON®-coated surface and image (e) shows a growing bubble on the same surface showing a similarly large receding contact angle. Image (f) shows a bubble ebullition cycle on a TEFLON®-coated surface exhibiting high-receding-angle growth. Note the different length and time scales indicated for images (c) and (f).

As a bubble grows and the contact line expands outward from the nucleation site, the liquid recedes away. The importance of the receding contact angle is clearly demonstrated in the single bubble dynamics near incipience, shown in FIG. 3. The bubble behavior on the PDMS-coated and TEFLON®-coated surfaces were drastically different despite having similar static contact angles (106° and 123°, respectively). On both surfaces, the contact angle of a receding droplet (images (a) and (d) of FIG. 3) closely matched the contact angle of liquid receding away from the site of a growing bubble (images (b) and (e) of FIG. 3) during the early stages of bubble growth before buoyancy begins to distort the bubble shape. As a result, on the PDMS-coated surface, the base diameter of the bubble remained small during low-receding-angle growth (image (c) of FIG. 3), which allowed most of the surface to remain wetted. Once the bubble became large enough, buoyancy forces exceeded the surface tension forces and the bubble departed. The minimal dewetting that occurred during bubble growth allowed the notionally hydrophobic PDMS-coated surface to maintain nucleate boiling. On the TEFLON®-coated surface, the base diameter of the bubble spread as the bubble grew with a high receding contact angle (image (f) of FIG. 3). A single bubble reached a base diameter of several millimeters, covering a large area of the surface in vapor prior to departure. Once the bubble reached some maximum base diameter, the bubble stretched upward due to buoyancy as it continued to grow and the contact angle became nearly perpendicular to the surface as the bubble shape became dominated by gravitational effect. The base diameter began to recede followed by the bubble departing by pinching off above the surface, leaving behind a small vapor bubble. Due to the extensive vapor spreading during bubble growth, active nucleation sites readily coalesced resulting in premature film boiling at a low heat flux.

To explain the role of the receding contact angle during bubble growth, an analytical model was derived to predict the bubble departure diameter and maximum base diameter. The model compared the buoyant force acting on the bubble, $F_b=(\rho_l-\rho_g)Vg$, where $\rho_l$ and $\rho_g$ are the densities of the liquid and vapor, V the bubble volume, and g the gravitational constant) with the vertical component of the surface tension force acting at the three-phase contact line, $F_s=\gamma(\pi D_b)\sin\theta$, where $\gamma$ is the liquid-vapor surface tension, $D_b$ the base diameter of the bubble, and $\theta$ the contact angle).

Figure 4:
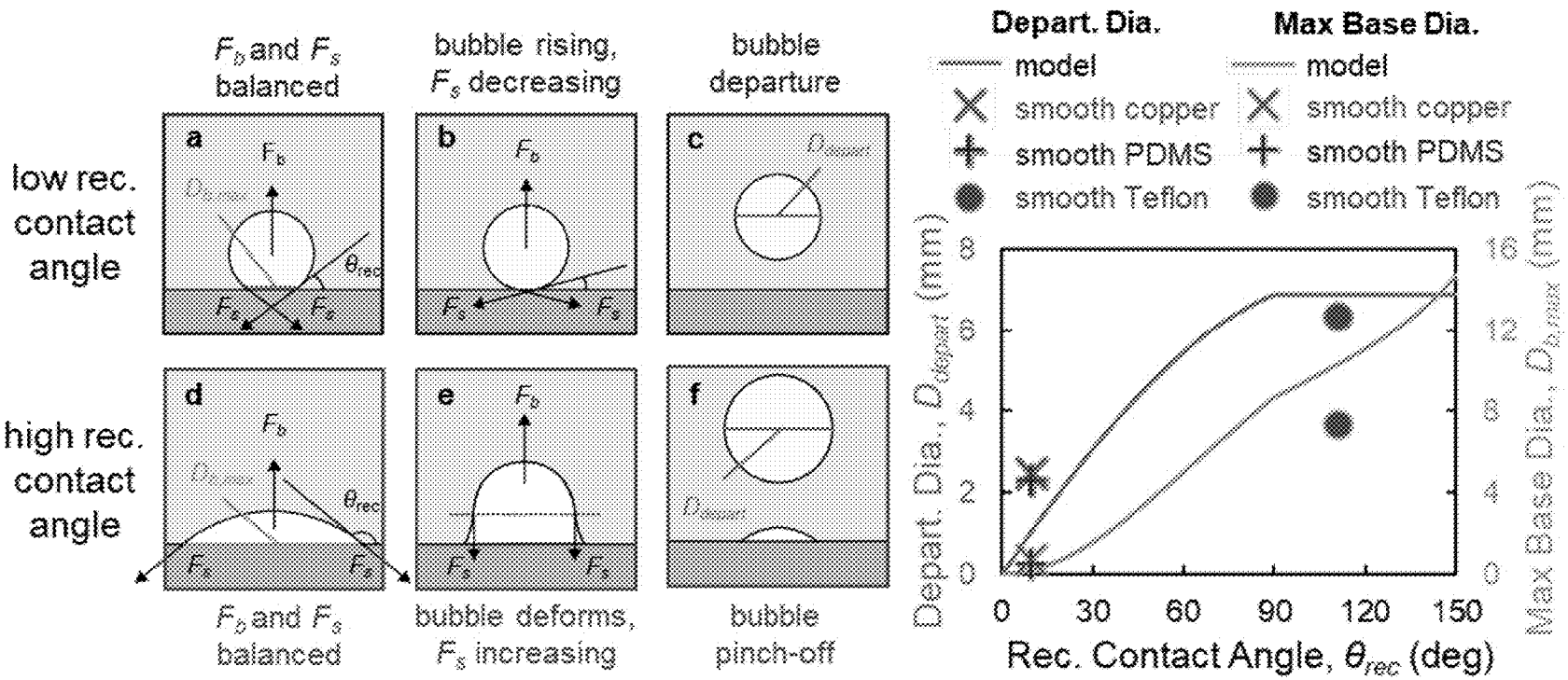
FIG. 4 contains images (a)-(f) illustrating approximate bubble growth progressions and a graph representing results of bubble growth model. The illustrations of bubble growth and departure on a surface include images (a)-(c) representing a low receding contact angle and images (d)-(f) representing a high receding contact angle. The graph plots results for the bubble departure diameter and maximum bubble base diameter plotted along with experimental results from the smooth surfaces.

For a surface with a low receding contact angle, the bubble growth progression can be approximated as illustrated in images (a)-(c) of FIG. 4. The bubble grows as a spherical cap with the liquid at the receding contact angle until it reaches a critical size at which the buoyant and surface tension forces are balanced (image (a) of FIG. 4). Then, the base diameter begins to retract as the bubble begins to rise and depart (image (b) of FIG. 4), and ultimately, departs from the surfaces as a sphere (image (c) of FIG. 4). Based on this progression, the maximum vertical component of the surface tension forces occurs when the buoyant and surface tension forces first become balanced (image (a) of FIG. 4). Thus, the maximum base diameter and departure diameter of the bubble can be determined by equating the buoyant and surface tension forces in this situation, assuming a spherical cap geometry at the receding contact angle. This results in a trend of increasing bubble departure diameter and maximum base diameter with increasing receding contact angle from 0 to 90°, as shown in image (g) of FIG. 4.

For a surface with a high receding contact angle, the bubble growth progression can be approximated as illustrated in images (d)-(f) of FIG. 4. The bubble grows as a spherical cap at the receding contact angle until it reaches a size at which the buoyant force and the vertical component of the surface tension force become balanced (image (d) of FIG. 4). The bubble base diameter begins to retract and the bubble begins to deform upward due to buoyant effects. As a result, the liquid contact angle decreases, causing the vertical component of the surface tension forces to increase as the bubble continues to grow. The limiting surface tension forces occurs when the interface is perpendicular to the surface (image (e) of FIG. 4). After this point, the bubble departs by pinching off at a location above the surface, leaving behind a small vapor bubble on the surface (image (f) of FIG. 4). Because of this, the limiting surface tension force is expected to occur at the pinch-off height, rather than at the surface. Based on this progression, the bubble size is determined based on the elongated bubble represented by image (e) of FIG. 4. The perpendicular angle with respect to the surface is assumed to occur at the height at which the pinch-off occurs. The departure volume, from which the departure diameter is trivially obtained, is determined by a balance of the buoyant and surface tension forces at an arbitrary pinch-off height assuming the bubble above the pinch-off height can be approximated as a spherical cap and the volume below the pinch-off location remains on the surface. Because the limiting surface tension forces occur at an angle perpendicular to the surface rather than at the receding contact angle, all surfaces with a receding contact angle greater than 90° are predicted to have the same departure diameter. The maximum base diameter is estimated by considering the volume of the departed bubble as a spherical cap with a contact angle equal to the receding contact angle, resulting in an increasing trend in maximum base diameter with increasing receding contact angle above 90°; this is expected to be an overestimate due to neglecting the bubble deformation by buoyancy.

The experimental results closely followed the trends of bubble departure diameter and base diameter with increasing receding contact angle and match the predicted magnitudes, as shown in image (g) of FIG. 4. The model slightly underpredicts the departure diameter on surface with a low receding contact angle and overpredicts the maximum base diameter on surfaces with a high receding contact angle. This agreement confirms the dominant role of the receding contact angle on bubble growth and departure dynamics.

Figure 5:
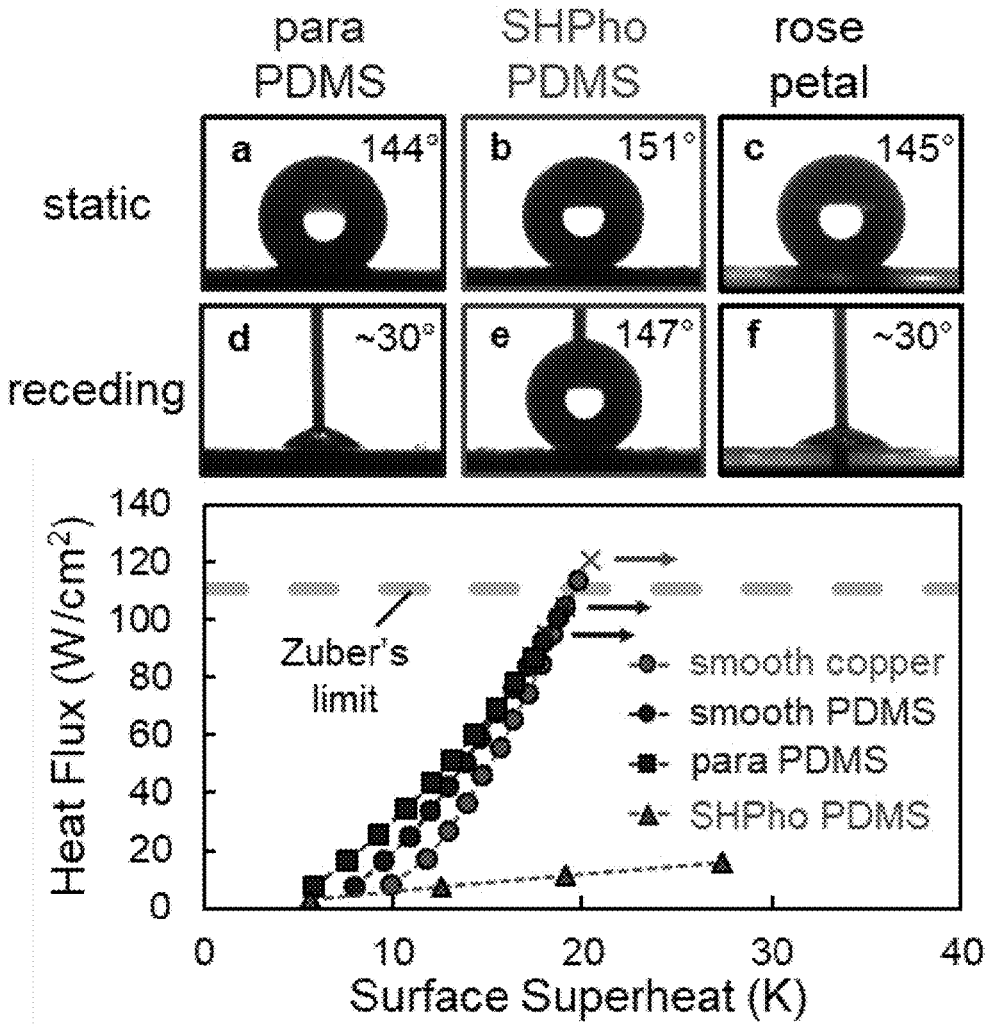
FIG. 5 represents wettability characterization and boiling results for textured PDMS-coated surfaces. Images (a), (b), and (c) of FIG. 5 show static 5 μL droplets on a parahydrophobic PDMS-coated surface (para PDMS), on a superhydrophobic PDMS-coated surface (SHPho PDMS), and on a rose petal, respectively. Images (d), (e), and (f) show a receding droplet on a parahydrophobic PDMS-coated surface, on a superhydrophobic PDMS-coated surface, and on a rose petal, respectively.

This conclusion that the receding contact angle governs or significantly effects bubble growth dynamics was used to design textured hydrophobic surfaces that provide favorable bubble dynamics to avoid critical heat flux while further enhancing nucleate boiling. Based on the results of the previous investigations, it was evident that the vapor spreading on hydrophobic surfaces can be mitigated by minimizing the receding contact angle of the surface. To demonstrate, the wettability characteristics and boiling performance of a high-hysteresis parahydrophobic surface versus a low-hysteresis superhydrophobic surface (in the Cassie-Baxter state) are reported in FIG. 5. Surface textures for the parahydrophobic surfaces were fabricated via chemical etching, and the surface texture for the superhydrophobic surface was created via laser etching. These surfaces included the same PDMS coating material, but their differing textures gave rise to the drastically different dynamic wetting behavior. The parahydrophobic PDMS-coated surface, which was textured to promote high adhesion, had a high static contact angle (143°) and a low receding contact angle (about 30°). Due to the high contact angle hysteresis, a 5 μL droplet deposited on the surface remained adhered even when tilted at a 90° angle or inverted. Textured to minimize contact angle hysteresis, the superhydrophobic PDMS-coated surface also had a high static contact angle (151°), but with a high receding contact angle (147°). Due to the minimal contact angle hysteresis, droplets readily rolled off the surface when tilted.

As hypothesized, the contrast in the receding contact angles resulted in stark differences in the boiling behavior and heat transfer performance. The superhydrophobic PDMS-coated surface had film boiling behavior immediately upon incipience and throughout the boiling curve, resulting in large surface superheat increases with increasing heat flux. The parahydrophobic PDMS-coated surface maintained nucleate boiling to a high heat flux and even further reduced surface temperatures compared with the smooth PDMS-coated surface; at a low heat flux of about 8 W/cm$^2$, a 60% increase in the heat transfer coefficient (heat flux divided by surface superheat) was observed compared with the smooth copper surface.

Figure 6:
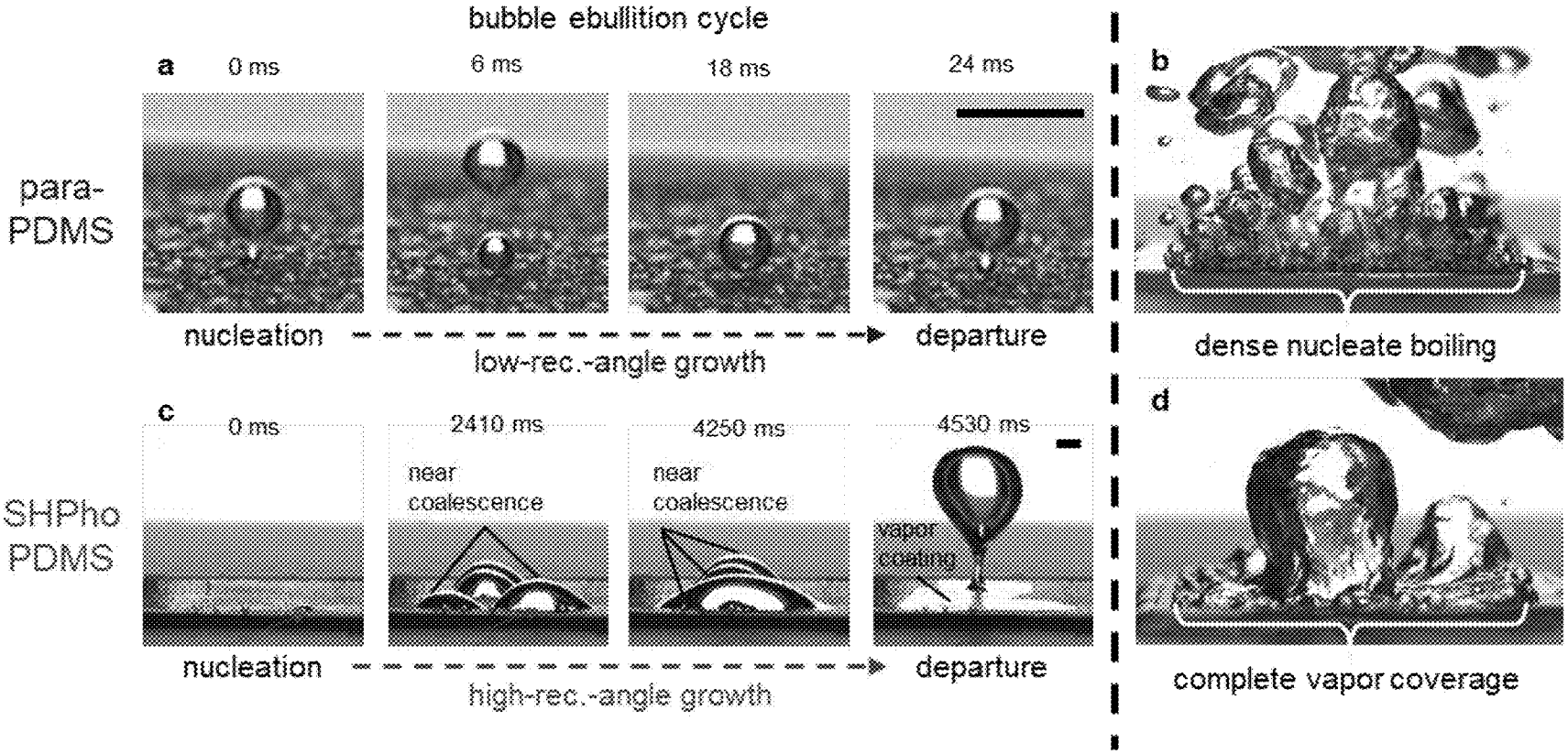
FIG. 6 represents a comparison of bubble ebullition cycles and boiling behaviors of textured PDMS-coated surfaces. Images (a) and (c) show a bubble ebullition cycle on a parahydrophobic PDMS-coated surface and on a superhydrophobic PDMS-coated surface, respectively, at incipience. Images (b) and (d) show low-heat-flux boiling behavior of the parahydrophobic PDMS-coated surface (heat flux: 7.8 W/cm$^2$; superheat: 5.8 K) and the superhydrophobic PDMS-coated surface (7.3 W/cm$^2$; 12.5 K), respectively.

The contrast in the boiling behavior of these two surfaces was a result of antithetical bubble growth dynamics. As presented in FIG. 6, the low receding contact angle characteristic of the parahydrophobic surface minimized the bubble base diameter during bubble growth; tiny bubbles had a near-perfect spherical shape as they grew and readily departed from the surface (image (a) of FIG. 6). This behavior sustained nucleate boiling even under conditions with dense, vigorous vapor formation across the entire surface by minimizing surface dewetting (image (b) of FIG. 6). On the superhydrophobic surface, the base diameter of the bubbles spread freely as the bubble grew at the receding contact angle. As a result, the first bubble that formed covered much of the surface in vapor and extensive surface-level coalescence occurred prior to a single bubble departure (image (c) of FIG. 6). Due to the promotion of the Cassie-Baxter state, this region trapped vapor in the interstices of the surface structures and was never able to rewet. Thus, the surface became blanketed in vapor easily, resulting in premature film boiling (image (d) of FIG. 6).

In Allred et al., superhydrophobic surfaces were shown to promote efficient nucleate boiling if brought into the Wenzel state prior to boiling, but promote ineffective film boiling if in the Cassie-Baxter state prior to boiling. The initial wetting state on the surface was controlling via the degassing procedure. Importantly, the parahydrophobic PDMS-coated surface in the second series of investigations noted above maintained nucleate boiling despite undergoing the same boiling procedure that normally promotes a Cassie-Baxter wetting state on superhydrophobic surfaces. Parahydrophobic surfaces can thereby remove the risk of premature film boiling, because they do not support a Cassie-Baxter wetting state. These surfaces capitalize upon the advantages of hydrophobicity (i.e. promotion of boiling incipience at low superheats and high nucleation site densities that yield efficient heat transfer) while mitigating the vapor spreading and premature film boiling that commonly plague hydrophobic boiling surfaces.

Figure 7:
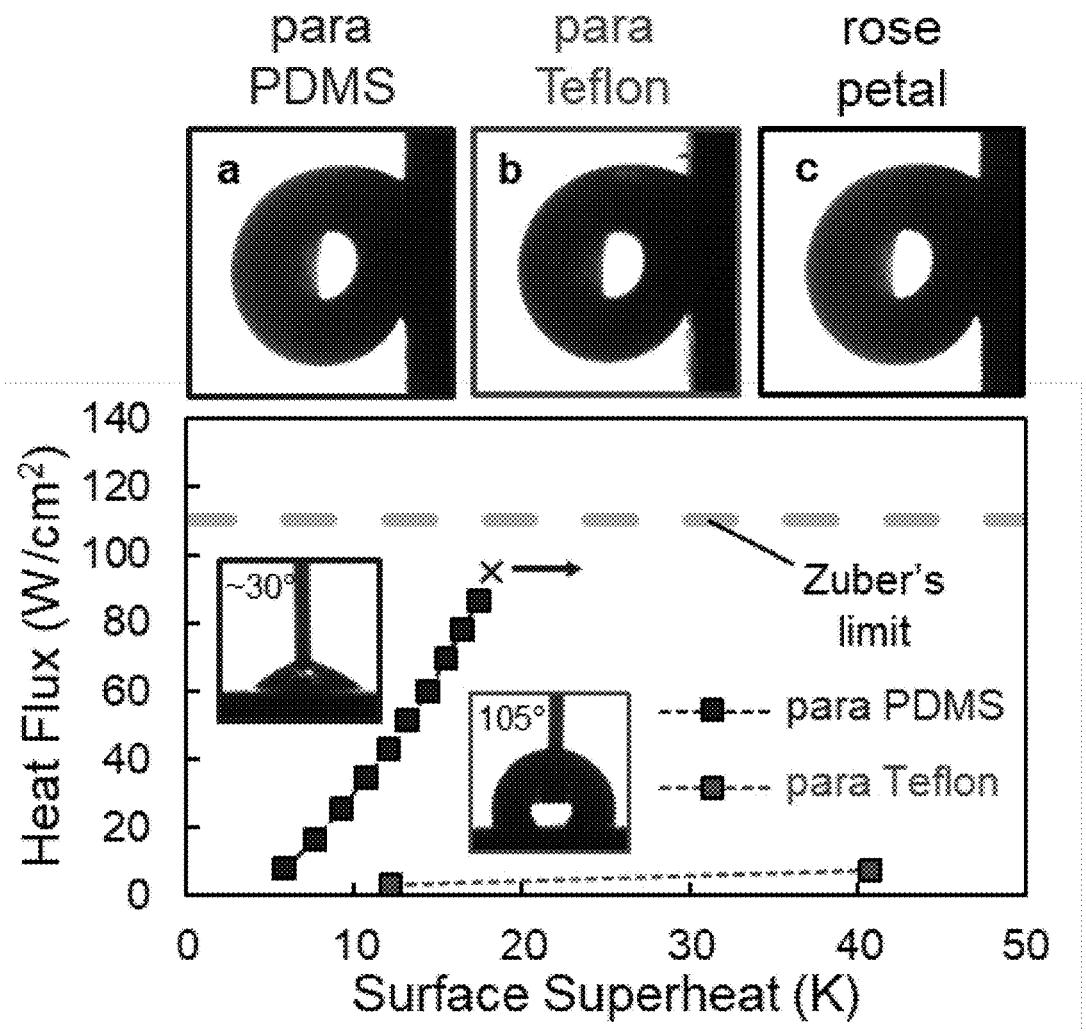
FIG. 7 represents wetting behavior and boiling results for parahydrophobic PDMS-coated (para PDMS) and TEFLON®-coated (para TEFLON®) surfaces. Images (a), (b), and (c) show a 5 μL droplet adhered to a parahydrophobic PDMS-coated surface, on a parahydrophobic TEFLON®-coated surface, and on a rose petal, respectively, while tilted at 90°.

However, as noted previously, a surface satisfying the notional criteria for parahydrophobicity does not necessarily ensure that it will yield these advantageous boiling characteristics. Because adhesion of a droplet to a surface when tilted is governed by the contact angle hysteresis, all notionally parahydrophobic surfaces do not necessarily possess the low receding contact angle required for maintaining nucleate boiling. This was demonstrated by evaluating the boiling performance of a parahydrophobic TEFLON®-coated surface with the same textured surface morphology as the parahydrophobic PDMS-coated surface, presented in image (b) of FIG. 7. The TEFLON®-coated surface is considered parahydrophobic owing to a high static contact angle of 135° and because a 5 μL droplet adheres to surface when tilted at 90° (attributable to a high contact angle hysteresis of about 40°), shown in image (a) of FIG. 7. Unlike for a PDMS coating, the parahydrophobic TEFLON®-coated surface has a high receding contact angle (105°) and was observed to undergo premature film boiling, resulting in significant increases in surface superheat with increasing heat flux. This reinforces the idea that the receding contact angle governs vapor spreading during boiling, rather than the contact angle hysteresis which is used to identify parahydrophobicity.

In the above-noted investigations, the wettability of each surface was characterized by static, advancing, and receding contact angles, whose values are summarized in Table 1 below. Static contact angles were measured by gently depositing a 5 μL droplet on the surface and measuring the angle with the solid surface using an automated goniometer. Advancing and receding contact angle measurements were obtained via the same goniometer by inserting a 0.3 mm outer-diameter stainless steel syringe tip into the 5 μL droplet and adding or removing liquid in 0.25 μL increments until a steady contact angle was observed. In the case of the textured surfaces with low receding contact angle, stick slip behavior was observed during dynamic contact angle measurements which prevented the formation of a steady receding contact angle. In this case, the lowest receding contact angle observed before the droplet became too small to accurately measure is reported. For the parahydrophobic surfaces, an additional test was performed to evaluate the adhesion of a droplet to the surface. A 5 μL droplet was gently placed on the surface. The surface was then tilted to 90° to see if the droplet remains adhered. The wettability of PDMS was observed to change after boiling in water. It was observed that the wettability of PDMS changed significantly within the first hour of boiling and then remained stable. Thus, the contact angles reported are those of a representative surface after being subjected to boiling water for two hours. The wetting properties of the parahydrophobic surfaces were also compared with a red Freedom hybrid tea rose, which was characterized in the same manner.

TABLE 1

Average contact angle measurements for each surface studied.

| | Static Contact Angle | Receding Contact Angle | Advancing Contact Angle | Contact Angle Hysteresis |
|---|---|---|---|---|
| Smooth copper | 52° | ~10° | 66° | 56° |
| Smooth PDMS | 106° | ~10° | 110° | 100° |
| Smooth TEFLON | 123° | 111° | 129° | 18° |
| Rose petal | 145° | ~30° | 154° | ~120° |
| Parahydrophobic PDMS | 144° | ~30° | 161° | ~130° |
| Superhydrophobic PDMS | 151° | 147° | 156° | 9° |
| Parahydrophobic TEFLON | 135° | 105° | 146° | 41° |

The investigations described herein clarified the roles of different wettability characteristics on boiling behavior. While the intrinsic wettability of the surface, evident through static contact angle measurements, played a role in the nucleation behavior and heat transfer efficiency of a surface during boiling, the receding contact angle appeared to be the dominant factor governing the bubble growth dynamics and, ultimately, the critical heat flux on surfaces in the absence of capillary wicking. Texturing hydrophobic surfaces to minimize the receding contact angle provided another avenue for further boiling performance enhancement. On the basis of the results obtained in the investigation, the upper limit for an acceptable receding contact angles is less than 105°, with particularly identified ranges being receding contact angles of up to 30° and up to 10°. The hydrophobic surfaces with lower receding contact angles evaluated in these investigations maintained the advantageous low-superheat boiling incipience and high active nucleation site densities commonly observed on hydrophobic surfaces, but prevented vapor from spreading over the surface during bubble growth. This resulted in decreased surface temperatures during nucleate boiling compared to hydrophilic surfaces and little to no detriment to critical heat flux.

While the invention has been described in terms of specific or particular embodiments and investigations, it should be apparent that alternatives could be adopted by one skilled in the art. For example, the boiling surface could be formed of various materials, could include coatings formed of various materials and deposited by various methods, and could have various surface textures. As such, it should be understood that the above detailed description is intended to describe the particular embodiments represented in the drawings and certain but not necessarily all features and aspects thereof, and to identify certain but not necessarily all alternatives to the embodiments and described features and aspects. As a nonlimiting example, the invention encompasses additional or alternative embodiments in which one or more features or aspects of a particular embodiment could be eliminated or two or more features or aspects of different embodiments could be combined. Accordingly, it should be understood that the invention is not necessarily limited to any embodiment described herein or illustrated in the drawings, and the phraseology and terminology employed above are for the purpose of describing the illustrated embodiments and investigations and do not necessarily serve as limitations to the scope of the invention. It should also be understood that the invention is not necessarily limited by descriptions, results, conclusions, or other statements that may be contained in documents cited above as incorporated herein by reference, though such statements may have been reasonably based on information and opinions that existed at the time these documents were written. Therefore, the scope of the invention is to be limited only by the following claims.

The invention claimed is:

1. A system comprising:

a boiling surface contacting and boiling a liquid, the surface being formed of a hydrophobic material to be parahydrophobic and having a sufficiently low receding contact angle of not greater than 90° such that vapor spreading during bubble growth and premature transition to film boiling is mitigated;

wherein a droplet of the liquid placed on the surface remains adhered thereto when the surface is tilted at 90° or inverted.

2. The system of claim 1, wherein the low receding contact angle is sufficiently low to prevent vapor spreading during bubble growth.

3. The system of claim 1, wherein the low receding contact angle is about 30° or less.

4. The system of claim 1, wherein the low receding contact angle is about 10° or less.

5. The system of claim 1, wherein the surface relative to the liquid has a static contact angle greater than 90°.

6. The system of claim 1, wherein the surface is a smooth surface having a surface roughness of up to 0.8 μm $R_a$.

7. The system of claim 1, wherein the surface is defined by a coating on a smooth surface having a surface roughness of up to 0.8 μm $R_a$.

8. The system of claim 1, wherein the surface is textured.

9. The system of claim 1, wherein the surface is defined by a coating deposited on a textured surface.

10. The system of claim 1, wherein the surface is entirely parahydrophobic.

11. The system of claim 1, wherein the surface is formed of polydimethylsiloxane (PDMS).

12. The system of claim 1, wherein the system is chosen from the group consisting of distillation, power generation, and cooling systems.

13. A method of boiling a liquid, the method comprising:

bringing the liquid into contact with the surface of the system of claim 1; and boiling the liquid while contacting the surface.

14. The method of claim 13, wherein the surface does not support a Cassie-Baxter state during boiling of the liquid.

15. A method of boiling a liquid, the method comprising:

preparing a boiling surface formed of a hydrophobic material to be parahydrophobic and have a receding contact angle of not greater than 90°, wherein a droplet of the liquid placed on the surface remains adhered thereto when the surface is tilted at 90° or inverted; and bringing the liquid into contact with the surface and boiling the liquid, the receding contact angle being sufficiently low such that vapor spreading during bubble growth and premature transition to film boiling is mitigated.

16. The method of claim 15, wherein the low receding contact angle is sufficiently low to prevent vapor spreading during bubble growth.

17. The method of claim 15, wherein the low receding contact angle is about 30° or less.

18. The method of claim 15, wherein the low receding contact angle is about 10° or less.

19. The method of claim 15, wherein the surface relative to the liquid has a static contact angle greater than 90°.

20. The method of claim 15, wherein the surface is entirely parahydrophobic.

* * * * *